United States Patent [19]

Miller

[11] 3,938,133

[45] Feb. 10, 1976

[54] CONDITIONING OF GAS DISCHARGE DISPLAY/MEMORY DEVICE

[75] Inventor: John W. V. Miller, Sylvania, Ohio

[73] Assignee: Owens-Illinois, Inc., Toledo, Ohio

[22] Filed: Dec. 3, 1971

[21] Appl. No.: 204,466

[52] U.S. Cl.... 340/324 M; 315/169 R; 340/166 EL

[51] Int. Cl.[2]..... G08B 5/36

[58] Field of Search..... 340/324 M, 166 R, 166 EL, 340/173 PL; 315/169 R, 169 TV; 179/7.3 D; 313/108 B

[56] References Cited

UNITED STATES PATENTS

| | | | |
|---|---|---|---|
| 3,499,167 | 3/1970 | Baker et al. | 315/169 TV X |
| 3,513,327 | 5/1970 | Johnson | 340/324 M X |
| 3,644,925 | 2/1972 | Kupsky | 315/169 TV X |

*Primary Examiner*—David L. Trafton
*Attorney, Agent, or Firm*—Donald Keith Wedding

[57] ABSTRACT

There is disclosed the conditioning of a gas discharge display/memory panel by applying a high voltage one cycle pulse to the non-utilized discharge cells of the panel. There is particularly disclosed a conditioning process for a multiple gas discharge display/memory panel having a plurality of discharge cells formed by a series of transversely positioned electrodes, the discharge cells being addressable in a series of matrices, each addressable matrix having a relative size of C by R discharge cells with a spacing between adjacent matrices of at least one column or one row of not-to-be addressed cells, and at least one high voltage cycle pulse being supplied to the not-to-be addressed cells of a matrix so as to condition the to-be addressed cells within the matrix.

8 Claims, 5 Drawing Figures

CONDITIONING OF GAS DISCHARGE DISPLAY/MEMORY DEVICE

BACKGROUND OF THE INVENTION

Figure 1:
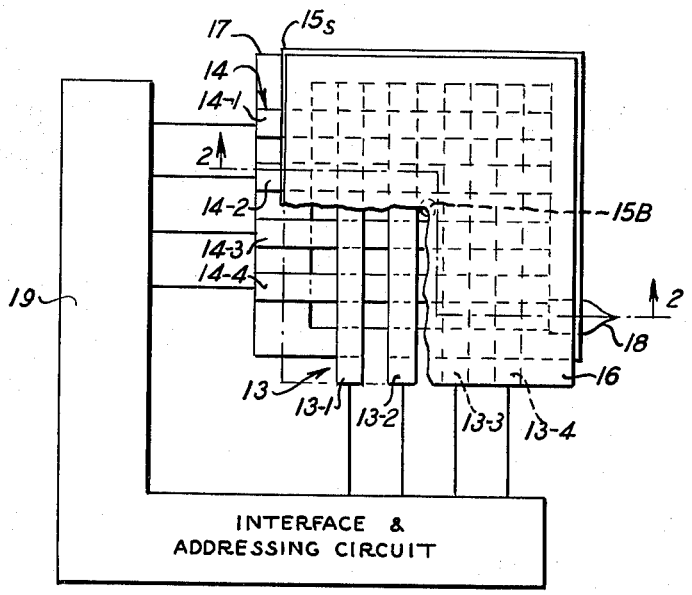

This invention relates to gas discharge devices, especially multiple gas discharge display/memory panels or units which have an electrical memory and which are capable of producing a visual display or representation of data such as numerals, letters, radar displays, aircraft displays, binary words, educational displays, etc.

Multiple gas discharge display and/or memory panels of one particular type with which the present invention is concerned are characterized by an ionizable gaseous medium, usually a mixture of at least two gases at an appropriate gas pressure, in a thin gas chamber or space between a pair of opposed dielectric charge storage members which are backed by conductor (electrode) members, the conductor members backing each dielectric member typically being appropriately oriented so as to define a plurality of discrete gas discharge units or cells.

In some prior art panels the discharge units are additionally defined by surrounding or confining physical structure such as by cells or apertures in perforated glass plates and the like so as to be physically isolated relative to other units. In either case, with or without the confining physical structure, charges (electrons, ions) produced upon ionization of the elemental gas volume of a selected discharge unit, when proper alternating operating potentials are applied to selected conductors thereof, are collected upon the surfaces of the dielectric at specifically defined locations and constitute an electrical field opposing the electrical field which created them so as to terminate the discharge for the remainder of the half cycle and aid in the initiation of a discharge on a succeeding opposite half cycle of applied voltage, such charges as are stored constituting an electrical memory.

Thus, the dielectric layers prevent the passage of substantial conductive current from the conductor members to the gaseous medium and also serve as collecting surfaces for ionized gaseous medium charges (electrons, ions) during the alternate half cycles of the A.C. operating potentials, such charges collecting first on one elemental or discrete dielectric surface area and then on an opposing elemental or discrete dielectric surface area on alternate half cycles to constitute an electrical memory.

An example of a panel structure containing non-physically isolated or open discharge units is disclosed in U.S. Letters Pat. No. 3,499,167 issued to Theodore C. Baker, et al.

An example of a panel containing physically isolated units is disclosed in the article by D. L. Bitzer and H. G. Slottow entitled "The Plasma Display Panel — A Digitally Addressable Display With Inherent Memory", Proceeding of the Fall Joint Computer Conference, IEEE, San Francisco, California, Nov. 1966, pp. 541–547. Also reference is made to U.S. Letters Pat. No. 3,559,190.

In the construction of the panel, a continuous volume of ionizable gas is confined between a pair of dielectric surfaces backed by conductor arrays typically forming matrix elements. The cross conductor arrays may be orthogonally related (but any other configuration of conductor arrays may be used) to define a plurality of opposed pairs of charge storage areas on the surfaces of the dielectric bounding or confining the gas. Thus, for a conductor matrix having H rows and C columns the number of elemental discharge units will be the product H × C and the number of elemental or discrete areas will be twice the number of such elemental discharge units.

In addition, the panel may comprise a so-called monolithic structure in which the conductor arrays are created on a single substrate and wherein two or more arrays are separated from each other and from the gaseous medium by at least one insulating member. In such a device the gas discharge takes place not between two opposing electrodes, but between two contiguous or adjacent electrodes on the same substrate; the gas being confined between the substrate and an outer retaining wall.

It is also feasible to have a gas discharge device wherein some of the conductive or electrode members are in direct contact with the gaseous medium and the remaining electrode members are appropriately insulated from such gas, i.e., at least one insulated electrode.

In addition to the matrix configuration, the conductor arrays may be shaped otherwise. Accordingly, while the preferred conductor arrangement is of the crossed grid type as discussed herein, it is likewise apparent that where a maximal variety of two dimensional display patterns is not necessary, as where specific standardized visual shapes (e.g., numerals, letters, words, etc.) are to be formed and image resolution is not critical, the conductors may be shaped accordingly, i.e., a segmented display.

The gas is one which produces visible light or invisible radiation which stimulates a phosphor (if visual display is an objective) and a copious supply of charges (ions and electrons) during discharge.

In prior art, a wide variety of gases and gas mixtures have been utilized as the gaseous medium in a gas discharge device. Typical of such gases include CO; $CO_2$; halogens; nitrogen; $NH_3$; oxygen; water vapor; hydrogen; hydrocarbons; $P_2O_5$; boron fluoride, acid fumes; $TiCl_4$; Group VIII gases; air; $H_2O_2$; vapors of sodium, mercury, thallium cadmium, rubidium, and cesium; carbon disulfide, laughing gas; $H_2S$; deoxygenated air; phosphorus vapors; $C_2H_2$; $CH_4$; naphthalene vapor; enthracene; freon; ethyl alcohol; methylene bromide; heavy hydrogen; electron attaching gases; sulfur hexafluoride, tritium; radioactive gases; and the rare or inert gases.

In one preferred embodiment thereof the medium comprises at least one rare gas, more preferabbly at least two, selected from neon, argon, krypton, xenon, or radon. Likewise, beneficial amounts of helium or mercury may be present.

In an open cell Baker, et al. type panel, the gas pressure and the electric field are sufficient to laterally confine charges generated on discharge within elemental or discrete dielectric areas within the perimeter of such areas, especially in a panel containing non-isolated units. As described in the Baker, et al. patent, the space between the dielectric surfaces occupied by the gas is such as to permit photons generated on discharge in a selected discrete or elemental volume of gas to pass freely through the gas space and strike surface areas of dielectric remote from the selected discrete volumes, such remote, photon struck dielectric surface areas thereby emitting electrons so as to condition at least one elemental volume other than the elemental volume in which the photons originated.

With respect to the memory function of a given discharge panel, the allowable distance or spacing between the dielectric surfaces depends, inter alia, on the frequency of the alternating current supply, the distance typically being greater for lower frequencies.

While the prior art does disclose gaseous discharge devices having externally positioned electrodes for initiating a gaseous discharge, sometimes called "electrodeless discharge", such prior art devices utilized frequencies and spacings or discharge volumes and operating pressures such that although discharges are initiated in the gaseous medium, such discharges are ineffective or not utilized for charge generation and storage at higher frequencies; although charge storage may be realized at lower frequencies, such charge storage has not been utilized in a display/memory device in the manner of the Bitzer-Slottow or Baker, et al. invention.

The term "memory margin" is defined herein as $$M.\ M. = \frac{V_f - V_E}{V_f/2}$$

where $V_f$ is the half amplitude of the smallest sustaining voltage signal which results in a discharge every half cycle, but at which the cell is not bi-stable and $V_E$ is the half amplitude of the minimum applied voltage sufficient to sustain discharges once initiated.

It will be understood that the basic electrical phenomenon utilized in this invention is the generation of charges (ions and electrons) alternately storable at pairs of opposed or facing discrete points or areas on a pair of dielectric surfaces backed by conductors connected to a source of operating potential. Such stored charges result in an electrical field opposing the field produced by the applied potential that created them and hence operate to terminate ionization in the elemental gas volume between opposed or facing discrete points or areas of dielectric surface. The term "sustain a discharge" means producing a sequence of momentary discharges, at least one discharge for each half cycle of applied alternating sustaining voltage, once the elemental gas volume has been fired, to maintain alternate storing of charges at pairs of opposed discrete areas on the dielectric surfaces.

In the operation of a multiple gaseous discharge device, of the type described hereinbefore, it is necessary to condition the discrete elemental gas volume of each discharge unit by supplying at least one free electron thereto such that a gaseous discharge can be initiated when the unit is addressed with an operating voltage signal.

The prior art has disclosed and practiced various means for conditioning gaseous discharge units.

One such method comprises the use of external radiation, such as flooding part or all of the gaseous medium of the panel with ultraviolet radiation. This external condition method has the obvious disadvantage that it is not always convenient or possible to provide external radiation to a panel, especially if the panel is in a remote position. Likewise, an external UV source requires auxiliary equipment. Accordingly, the use of internal conditioning is generally preferred.

One internal conditioning means comprises using internal radiation, such as by the inclusion of a radioactive material and/or by the use of one or more so-called pilot discharge unit for the generation of photons.

As described in the Baker, et al. patent, the space between the dielectric surfaces occupied by the gas is such as to permit photons generated on discharge in a selected discrete or elemental volume of gas (discharge unit) to pass freely through the panel gas space so as to condition other and more remote elemental volumes of other discharge units.

However, such internal photon generation and electron conditioning of the panel gaseous medium becomes unreliable when a given discharge unit to be addressed is remote in distance (an inch or more) relative to the conditioning source, e.g., the pilot unit. Thus, a multiplicity of pilot units or cells may be required for the conditioning of a panel having a large geometric area.

Another means of panel conditioning comprises a so-called electronic process whereby an electronic conditioning signal or pulse is periodically applied to all of the panel discharge units, as disclosed for example in British Patent specification No. 1,161,832, page 8, lines 56 to 76. However, electronic conditioning is self-conditioning and is only effective after a discharge unit has been previously conditioned; that is, electronic conditioning involves periodically discharging a unit and is therefore a way of maintaining the presence of free electrons. Accordingly, one cannot wait too long between the periodically applied conditioning pulses since there must be at least one free electron present in order to discharge and condition a unit.

In accordance with the practice of this invention, there is provided an improved process of conditioning gaseous discharge panels, especially panels having a large geometric area.

More particularly, there is provided a conditioning process for a multiple gas discharge display/memory panel having a plurality of discharge cells formed by a series of transversely positioned electrodes, said discharge cells being geometrically arranged in rows and columns and the panel being electrically addressable in a plurality of matrices formed by rows and columns of discharge cells, each addressable matrix having a relative size of C by R discharge cells with a spacing between adjacent matrices of at least one column or one row of not-to-be addressed discharge cells, which conditioning process comprises supplying at least one high voltage cycle pulse to the not-to-be addressed cells so as to condition the to-be addressed cells within the matrix.

The high voltage cycle pulse must be sufficient to discharge each cell in the conditioning row or column of the not-to-be addressed cells so as to provide free electrons for the to-be addressed cells.

The discharge of the conditioning cells is further effected by having one or more pilot cells in the "on" state at or near the vicinity of at least one of the conditioning rows. Thus, at least the end cells of the conditioning row are well-conditioned, and when they are discharged or fired by the conditioning pulse, they will condition their neighbors, so that before the end of the conditioning pulse, every cell of the conditioning row has been well enough conditioned to fire.

Figure 2:
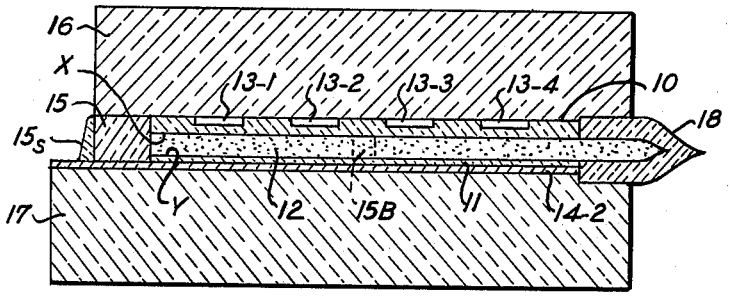
Figure 3:
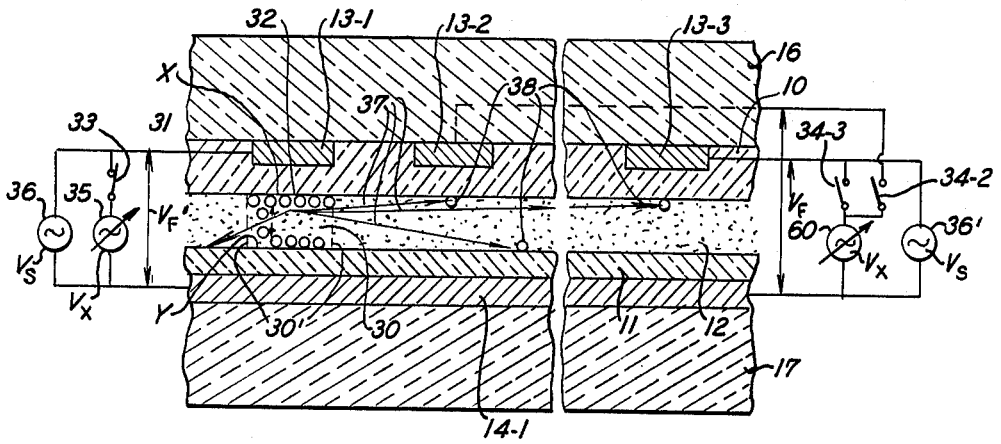
Figure 4:
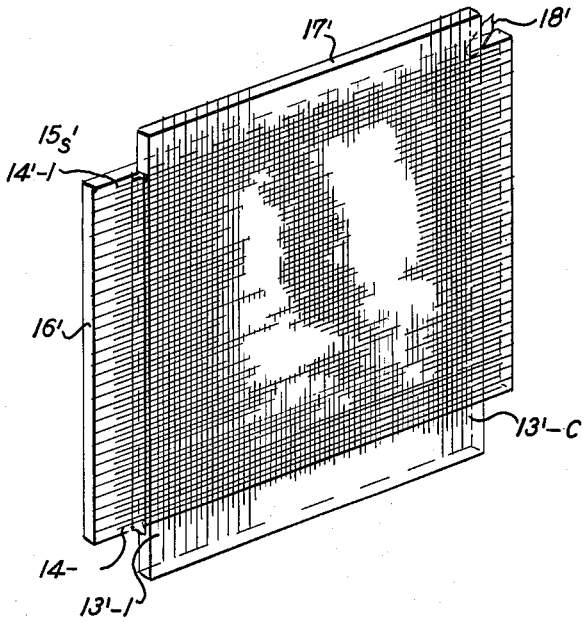
Figure 5:
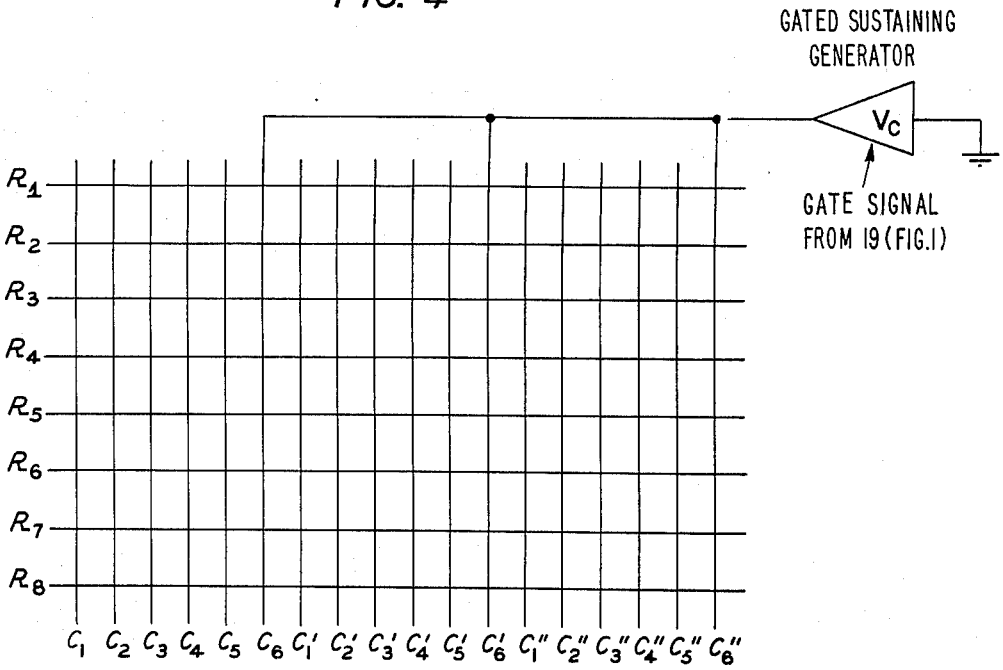

The above, as well as other objects, features and advantages of the invention will become apparent and better understood by reference to the following detailed description when considered in connection with the accompanying drawings wherein;

FIG. 1 is a partially cut-away plan view of a gaseous discharge display/memory panel as connected to a diagrammatically illustrated source of operating potentials, FIG. 2 is a cross-sectional view (enlarged, but not to proportional scale since the thickness of the gas volume, dielectric members and conductor arrays have been enlarged for purposes of illustration) taken on lines 2 — 2 of FIG. 1, FIG. 3 is an explanatory partial cross-sectional view similar to FIG. 2 (enlarged, but not to proportional scale), FIG. 4 is an isometric view of a gaseous discharge display/memory panel, FIG. 5 is a view of a portion of the viewing surface of a row-column panel.

The invention utilizes a pair of dielectric films or coatings 10 and 11 separated by a thin layer or volume of a gaseous discharge medium 12, said medium 12 producing a copious supply of charges (ions and electrons) which are alternately collectable on the surfaces of the dielectric members at opposed or facing elemental or discrete areas X and Y defined by the conductor matrix on nongas-contacting sides of the dielectric members, each dielectric member presenting large open surface areas and a plurality of pairs of elemental X and Y areas. While the electrically operative structural members such as the dielectric members 10 and 11 and conductor matrixes 13 and 14 are all relatively thin (being exaggerated in thickness in the drawings) they are formed on and supported by a rigid nonconductive support members 16 and 17 respectively.

Preferably, one or both of nonconductive support members 16 and 17 pass light produced by discharge in the elemental gas volumes. Preferably, they are transparent glass members and these members essentially define the overall thickness and strength of the panel. For example, the thickness of gas layer 12 as determined by spacer 15 is under 10 mils and preferably about 5 to 6 mils, dielectric layers 10 and 11 (over the conductors at the elemental or discrete X and Y areas) is between 1 and 2 mils thick, and conductors 13 and 14 about 8,000 angstroms thick (tin oxide). However, support members 16 nd 17 are much thicker (particularly larger panels) so as to provide as much ruggedness as may be desired to compensate for stresses in the panel. Support members 16 and 17 also serve as heat sinks for heat generated by discharges and thus minimize the effect of temperature on operation of the device. If it is desired that only the memory function be utilized, then none of the members need be transparent to light although for purposes described later herein it is preferred that one of the support members and members formed thereon be transparent to or pass ultraviolet radiation.

Except for being nonconductive or good insulators the electrical properties of support members 16 and 17 are not critical. The main function of support members 16 and 17 is to provide mechanical support and strength for the entire panel, particularly with respect to pressure differential acting on the panel and thermal shock. As noted earlier, they should have thermal expansion characteristics substantially matching the thernal expansion characteristics of dielectric layers 10 and 11. Ordinary ¼ inch commercial grade soda lime plate glasses have been used for this purpose. Other glasses such as low expansion glasses or transparent devitrified glasses can be used provided they can withstand processing and have expansion characteristics substantially matching expansion characteristics of the dielectric coatings 10 and 11. For given pressure differentials and thickness of plates, the stress and deflection of plates may be determined by following standard stress and strain formulas (see R. J. Roark, *Formulas for Stress and Strain*, McGraw-Hill, 1954).

Spacer 15 may be made of the same glass material as dielectric films 10 and 11 and may be an integral rib formed on one of the dielectric members and fused to the other members to form a bakeable hermetic seal enclosing and confining the ionizable gas volume 12. However, a separate final hermetic seal may be effected by a high strength devitrified glass sealant 15S. Tubulation 18 is provided for exhausting the space between dielectric members 10 and 11 and filling that space with the volume of ionizable gas. For large panels small bean like solder glass spacers such as shown as 15B may be located between conductors intersections and fused to dielectric members 10 and 11 to aid in withstanding stress on the panel and maintain uniformity of thickness of gas volume 12.

Conductor arrays 13 and 14 may be formed on support members 16 and 17 by a number of well known processes, such as photoetching, vacuum deposition, stencil screening, etc. In the panel shown in FIG. 4, the center-to-center spacing of conductors in the respective arrays is about 30 mils. Transparent or semi-transparent conductive material such as tin oxide, gold or aluminum can be used to form the conductor arrays and should have a resistance less than 3000 ohms per line. It is important to select a conductor material that is not attacked during processing by the dielectric material.

It will be appreciated that conductor arrays 13 and 14 may be wires or filaments of copper, gold, silver or aluminum or any other conductive metal or material. For example 1 mil wire filaments are commercially available and may be used in the invention. However, formed in situ conductor arrays are preferred since they may be more easily and uniformly placed on and adhered to the support plates 16 and 17.

Dielectric layer members 10 and 11 are formed of an inorganic material and are preferably formed in situ as an adherent film or coating which is not chemically or physically effected during bake-out of the panel. One such material is a solder glass such as Kimble SG-68 manufactured by and commercially available from the assignee of the present invention.

This gas has thermal expansion characteristics substantially matching the thermal expansion characteristics of certain soda-lime glasses, and can be used as the dielectric layer when the support members 16 and 17 are soda-lime glass plates. Dielectric layers 10 and 11 must be smooth and have a dielectric strength of about 1000 v. and be electrically homogeneous on a microscopic scale (e.g., no cracks, bubbles, crystals, dirt, surface film, etc.). In addition, the surfaces of dielectric layers 10 and 11 should be good photoemitters of electrons in a baked out condition. However, a supply of free electrons for conditioning gas 12 for the ionization process may be provided by inclusion of a radioactive material within the glass or gas space. A preferred range of thickness of dielectric layers 10 and 11 overlying the conductor arrays 13 and 14 is between 1 and 2 mils. Of course, for an optical display at least one of dielectric layers 10 and 11 should pass light generated on discharge and be transparent or translucent and, preferably, both layers are optically transparent.

The preferred spacing between surfaces of the dielectric films is about 5 to 6 mils with conductor arrays 13 and 14 having center-to-center spacing of about 30 mils.

The end of conductors 14-1 . . . 14-4 and support member 17 extend beyond the enclosed gas volume 12 and are exposed for the purpose of making electrical connection to interface and addressing circuitry 19. Likewise, the ends of conductors 13-1 . . . 13-4 on support member 16 extend beyond the enclosed gas volume 12 and are exposed for the purpose of making electrical connection to interface and addressing circuitry 19.

As is known display systems, the interface and addressing circuitry or system 19 may be relatively inexpensive line scan systems or the somewhat more expensive high speed random access systems. However, it is to be noted that a lower amplitude of operating potentials helps to reduce problems associated with the interface circuitry between the addressing system and the display/memory panel, per se. thus, by providing a panel having greater uniformity in the discharge characteristics throughout the panel, tolerances and operating characteristics of the panel with which the interfacing circuitry cooperate, are made less rigid.

In FIG. 5 there is shown three row-column matrices of a gaseous discharge display/memory panel, each matrix comprising eight rows ($R_1$ through $R_8$) and six columns ($C_1$ through $C_6$; $C_1'$ through $C_6'$; and $C_1''$ through $C_6''$). However, the addressable portion of each matrix is only seven rows by five columns — with one end row ($R_1$ or $R_8$) being used for matrix border spacing and one column located in between each matrix ($C_6$, $C_6'$, and $C_6''$) being used for matrix border spacing.

In the practice of this invention, a selected portion of the not-to-be addressed cells of row $R_1$ or $R_8$ are discharged by the application of an appropriate potential so as to provide conditioning electrons at the to-be addressed cells of each matrix.

Although not illustrated in the drawing, a pilot cell should be located in the general vicinity of the matrix border conditioning row and/or column in order to facilitate conditioning of the cells therein. Such pilot is continuously in the "on" state and is photonically connected to one or more of the cells to be discharged in the border row or column. Thus, as shown in the diagramtic illustration of FIG. 3, a pilot cell or site, such as defined by column conductors 13-1 and row conductor 14-1, may be located in the vicinity of the matrix border.

The practice of this invention enables one to economically condition a gas discharge display/memory panel by tying non-utilized border columns and/or rows to a special high voltage pulse generator, the pulse being of any suitable frequency and waveform (square, sine, etc.).

This invention is particularly useful in an alphanumeric display. In alpha-numeric displays, there are border lines (rows or columns) between characters which are not used. Tying these lines to a specially gated sustaining generator which turns all cells along the lines on which a write pulse is requested, conditions all character blocks in the entire panel. One pilot cell is typically left on at all times to condition the grid lines, but no other conditioning sources are required for complete random access in any alpha-numeric block.

I claim;

1. In a process for conditioning multiple gas discharge display/memory panel, having a relatively large geometrical area, and containing an ionizable gaseous medium and having a plurality of discharge cells formed by a pair of transversely related electrodes, said discharge cells being geometrically arranged in rows and columns and the panel being electrically addressable in a plurality of matrices for displaying alphanumeric characters formed by selected rows and columns of addressable discharge cells, each addressable matrix within said panel having a relative size of C by R discharge cells with a spacing between adjacent addressable matrices of at least one column or one row of not-to-be addressed discharge cells and a series of panel border discharge cells being maintained in the one state to constitute pilot cells, the improvement which comprises conditioning a selected portion of the panel by supplying at least one high voltage cycle pulse to the not-to-be addressed cells between addressable matrices so as to photonically condition the to-beaddressed cells within the adjoining matrices.

2. The invention of claim 1 wherein there are no physical barriers between adjacent discharge cells and the gaseous medium comprises at least one rare gas at a pressure sufficient to laterally confine charges generated on discharge within the area of the perimeter of the cell.

3. The invention of claim 2 wherein the gas medium comprises at least two rare gases selected from none, argon, krypton, xenon, and radon.

4. The invention of claim 3 wherein the gas medium contains beneficial amounts of at least one member selected from helium and mercury.

5. In a multiple gas discharge display/memory panel having a large geometrical area and containing an ionizable gaseous medium a plurality of discharge cells openly photonically connected formed by a series of transversely related electrodes, said discharge cells being geometrically arranged in rows and columns, and the panel being electrically addressable in a plurality of individual sub-matrices formed by rows and columns of discharge cells, each addressable sub-matrix having a relative size of C by R discharge cells with a spacing between adjacent sub-matrices of at least one column or one row of not-to-be addressed discharge cells, the improvement wherein the not-to-be addressed cells are in open photonic communication with said addressable submatrices and are connected to a high voltage cycle pulse source so as to discharge at least a portion of the not-to-be addressed cells and condition the to-be addressed cells within each said sub-matrix.

6. The invention of claim 5 wherein the gaseous medium comprises at least one rare gas.

7. The invention of claim 6 wherein the gaseous medium comprises at least two rare gases from neon, argon, krypton, xenon, and radon.

8. The invention of claim 7 wherein the gas medium contains beneficial amounts of at least one member selected from helium and mercury.

* * * * *